US008690739B2

(12) United States Patent
Fazio

(10) Patent No.: US 8,690,739 B2
(45) Date of Patent: Apr. 8, 2014

(54) BOXING TRAINING DEVICE

(75) Inventor: Raimondo Fazio, Kinsley (AU)

(73) Assignee: Raimondo Fazio, Kingsley (AU)

( * ) Notice: Subject to any disclaimer, the term of this patent is extended or adjusted under 35 U.S.C. 154(b) by 685 days.

(21) Appl. No.: 12/991,047

(22) PCT Filed: May 12, 2009

(86) PCT No.: PCT/AU2009/000588

§ 371 (c)(1),
(2), (4) Date: Nov. 4, 2010

(87) PCT Pub. No.: WO2009/137869

PCT Pub. Date: Nov. 19, 2009

(65) Prior Publication Data

US 2011/0059827 A1 Mar. 10, 2011

Related U.S. Application Data

(60) Provisional application No. 61/092,775, filed on Aug. 29, 2008.

(30) Foreign Application Priority Data

May 13, 2008 (AU) ..... 2008902322

(51) Int. Cl.

| | |
|---|---|
| ***A63B 69/20*** | (2006.01) |
| ***A63B 69/22*** | (2006.01) |
| ***A63B 69/24*** | (2006.01) |

(52) U.S. Cl.
USPC ..... 482/90; 482/86

(58) Field of Classification Search
USPC ..... 482/12, 44–50, 62, 83–90, 905; 273/440, 440.1; 473/441–445; D21/787, 798
See application file for complete search history.

(56) References Cited

U.S. PATENT DOCUMENTS

| | | | | |
|---|---|---|---|---|
| 5,256,069 | A | 10/1993 | Snowden, Jr. et al. | |
| 5,735,775 | A | 4/1998 | Miasserian | |
| 6,896,630 | B1 * | 5/2005 | Breining | 473/422 |
| 7,329,210 | B1 * | 2/2008 | Marano | 482/83 |
| 7,922,628 | B2 * | 4/2011 | Gonzalez | 482/90 |
| 8,079,938 | B2 * | 12/2011 | Jones et al. | 482/8 |
| 2007/0197351 | A1 * | 8/2007 | Gonzalez | 482/83 |
| 2009/0264262 | A1 * | 10/2009 | Brenner et al. | 482/83 |

FOREIGN PATENT DOCUMENTS

CA 2163776 A1 11/1995

OTHER PUBLICATIONS

International Search Report dated Jul. 2, 2009 in corresponding international patent application No. PCT/AU2009/000588, 2 pages.
Derwent Abstract Accession No. 90-244658/32, SU 1537281 A (Yankovskii) Jan. 23, 1990.

* cited by examiner

*Primary Examiner* — Oren Ginsberg
(74) *Attorney, Agent, or Firm* — Maier & Maier, PLLC

(57) ABSTRACT

A boxing training device including a support frame, a first set of pads each resiliently secured relative to the support frame and a second set of pads each resiliently connected relative to the support frame. The first set of pads comprises a plurality of pads located at multiple heights having faces angled towards a right hand side of a boxer for receiving right handed blows and the second set of pads comprises a plurality of pads located at multiple heights having faces angled towards a left hand side of a boxer for receiving left handed blows.

19 Claims, 7 Drawing Sheets

BOXING TRAINING DEVICE

RELATED APPLICATIONS

This application is the U.S. national stage application which claims priority under 35 U.S.C. §371 to International Patent Application No.: PCT/AU2009/000588, filed on May 12, 2009, which claims priority under 35 U.S.C. §119, to Australian Patent Application No.: 2008902322, filed on May 13, 2008, which claims priority under 35 U.S.C. §119(e) to U.S. Provisional Patent Application No. 61/092,775, filed on Aug. 29, 2008, the disclosures of which are all incorporated by reference herein in their entirety.

FIELD OF THE INVENTION

The present invention relates to training devices and methods including, in particular, those for boxing.

BACKGROUND TO THE INVENTION

A common training exercise in the sport of boxing involves punching pads held by a trainer. The pads are moved between different positions by the trainer so that the boxer can practise various punches.

While this type of training is useful and effective, it requires access to a trainer and therefore cannot be used if no access to a trainer is available. Also, in a gym where trainers may be available, only a limited number of participants can use this type of training at any one time.

Furthermore trainers providing this type of training are often exposed to repetitive stresses associated with using punch pads of this type. Holding pads up and taking the impact of the punches places stresses on the arm joints of the trainer which, in the long term, can cause significant injuries, particularly to the trainer's shoulders.

While exercise devices exist that do allow a person to practice on punching pads, such as bags or padded body-shaped apparatus, these devices do not replicate particularly well the exercises conducted by a trainer holding pads.

It is against this background and the problems and difficulties associated therewith that the present invention has been developed.

References to prior art in this specification are provided for illustrative purposes only and are not to be taken as an admission that such prior art is part of the common general knowledge in Australia or elsewhere.

SUMMARY OF THE INVENTION

According to a first aspect of the present invention there is provided a boxing training device comprising:

a support frame;

a first set of pads each resiliently secured relative to the support frame comprising a plurality of pads located at multiple heights having faces angled towards a right hand side of a boxer for receiving right handed blows;

a second set of pads each resiliently connected relative to the support frame comprising a plurality of pads located at multiple heights having faces angled towards a left hand side of a boxer for receiving left handed blows;

a first arrangement of pads including from each of the first and second sets, the first arrangement of pads defining a concave inwardly hitting region; and a second arrangement of pads including pads from each of the first and second sets defining an convex hitting surface;

wherein the second arrangement of pads comprises a single central padded arrangement having first and second side surfaces forming the convex hitting surface.

Preferably the second arrangement includes a front surface directed towards the boxer for receiving right and left hand strikes, the front surface located between the first and second side surfaces. The front surface is preferably angled to the vertical such that the upper end thereof is closer to the boxer such that the front surface is for receiving uppercuts.

In a preferred embodiment, the pads are secured to the support frame by arm members each including a spring member to provide the resilient connection and the second arrangement is secured to the support frame by a single arm member.

Preferably the second arrangement includes an upper surface extending between the first and second side surfaces angled downwardly towards the front surface such that the upper surface can be used as a head support or can receive downwardly directed elbow blows. Preferably the single arm member connecting the second arrangement is angled downwardly from the support frame.

In one embodiment, the first side surface includes a first right area for receiving right rips and a second right area located behind the first right area for receiving right hooks and the second side surface includes a first left area for receiving left rips and a second left area located behind the first left area for receiving left hooks.

Preferably, the pads comprise the first, arrangement of pads is located for receiving a set of strikes comprising head high punches and the second arrangement of pads is located for receiving a set of strikes comprising body height punches. A third arrangement of pads is preferably provided below the second arrangement of pads for receiving a set of strikes comprising left and right rips from a user standing in a central position in front of the device.

Each pad may be mounted on a plate member and the spring member provided between the plate member and the arm member. In one embodiment, the spring member comprises a coil spring.

In a preferred embodiment, the first arrangement comprises a first pad arranged for receiving right overhand and right hook punches, a second pad for receiving right straight punches, a third pad for receiving left straight punches and a fourth pad for receiving left overhand and left hook punches. The first and fourth pads are preferably arranged outside and lower than the second and third pads. Each of the first, second, third and fourth pads are preferably connected to the support frame by a respective arm member.

In one embodiment, the third arrangement comprises first and second pads provided on respective arm members extending generally away from each other, the first pad arranged for receiving right rips and the second pad arranged for receiving left rips. In one embodiment, the third arrangement includes a third pad mounted between the first and second pads on the sleeve, the third pad for receiving strikes including left and right rips and push kicks.

In a preferred embodiment, the arm members are removable from the support frame. The arm members are preferably provided with connection plates at ends remote from the pads, the connection plates having holes therein to receive securing bolts fixable to the support frame The support frame may comprise a vertical post secured to the ground. A sleeve may be provided for receiving the post, the arm members of the device being secured to the sleeve and the sleeve being slidable up and down the post to adjust the height of the pads. The sleeve may includes fixing pins receivable in apertures in the post to secure the sleeve relative to the post.

As will be described in further detail below, preferred forms of the present invention may provide:

(i) A training bag that allows focus pad type training whilst protecting the trainer from a broad range of injuries to the shoulder, elbow and wrist area.

(ii) A training device that allows trainers previously considered unfit for training boxers, due to injury or otherwise, to re-enter the boxing profession and provide students with the benefit of their skill, knowledge and experience.

(iii) A training device that encourages trainers to provide the student with focus pad training as opposed to training on a punch bag, and upper cut bag. Bags of this nature are generally not able to recreate the realism and the excitement of a session using focus pads.

(iv) A training device that forces the student to maintain their hands at a desirable height when throwing straight rights, lefts, overhands or hooks as if aiming for the head of an upright person.

(v) A training device that allows the trainer to step away from the boxer and observe their technique at different angles including from behind. Advantageously this allows the trainer to adjust the feet, legs, elbows, shoulders and head whilst the student is throwing punches.

(vi) A training device that reduces the number of trainers required for training and which is suitable for trainers who are inexperienced in boxing (vii) Fitness organisations and private gyms who have group classes can place four devices back to back in a north south east, west configuration and train four boxers at once.

(viii) Devices fitted with sensors to calculate how many punches and pressure of the impact of the punches during a focus pad session.

(ix) Devices that are ideal for training boxers, kick boxers, ultimate fighters and other martial artists.

Throughout the specification unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of embodiments of the boxing training device, given by way of example only, with reference to the accompanying drawings, in which.

DETAILED DESCRIPTION OF PREFERRED EMBODIMENTS

Figure 1:
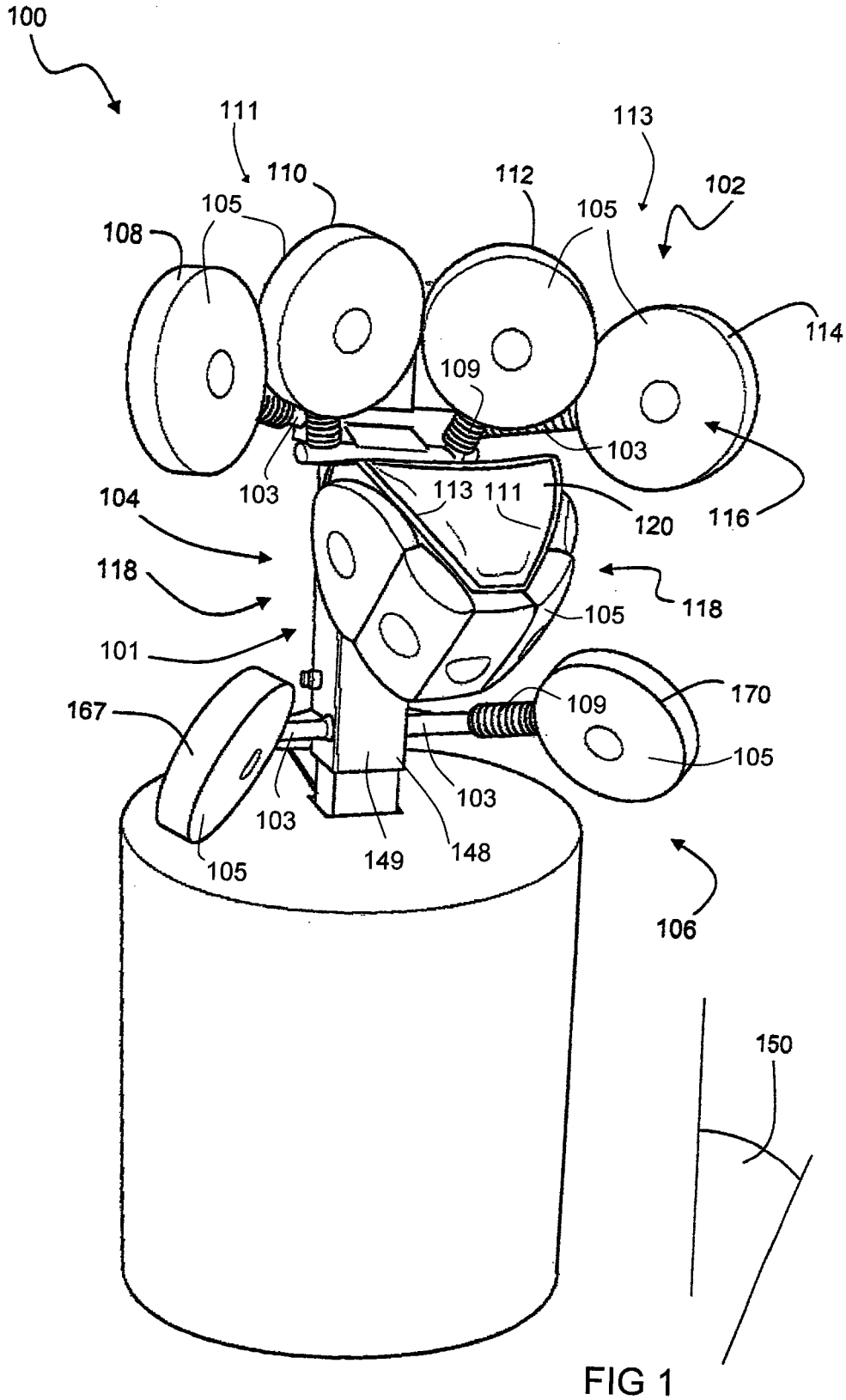
FIG. 1 is a perspective view of a training device according to the present invention.

Referring to the Figures there is shown a boxing training device 100 according to the present invention. It is considered that the device 100 is able to advantageously recreate the excitement and realism associated with a training session on focus pads whilst protecting the trainer from common problems associated with focus pad training.

The boxing training device 100 comprises a support frame 101 and a plurality of arm members 103 extending outwardly from the support frame 101. In the embodiment shown, the support frame 101 comprises a vertically mounted post 148 secured at a lower end to the floor. A sleeve 149 is provided having the same cross sectional shape as the post 148 and dimensioned to receive the post 148 such that the sleeve 149 can be slid upwards or downwards relative to the post 148. Each of the arm members 103 is fixed to the sleeve 149 such that sliding the sleeve 149 up or down the post 148 allows the heights of the arm members 103 to be adjusted. The sleeve 149 is provided with fixing pins 153 which are received in apertures provided in the post 148 to hold the sleeve 149 at the appropriate height.

Figure 3:
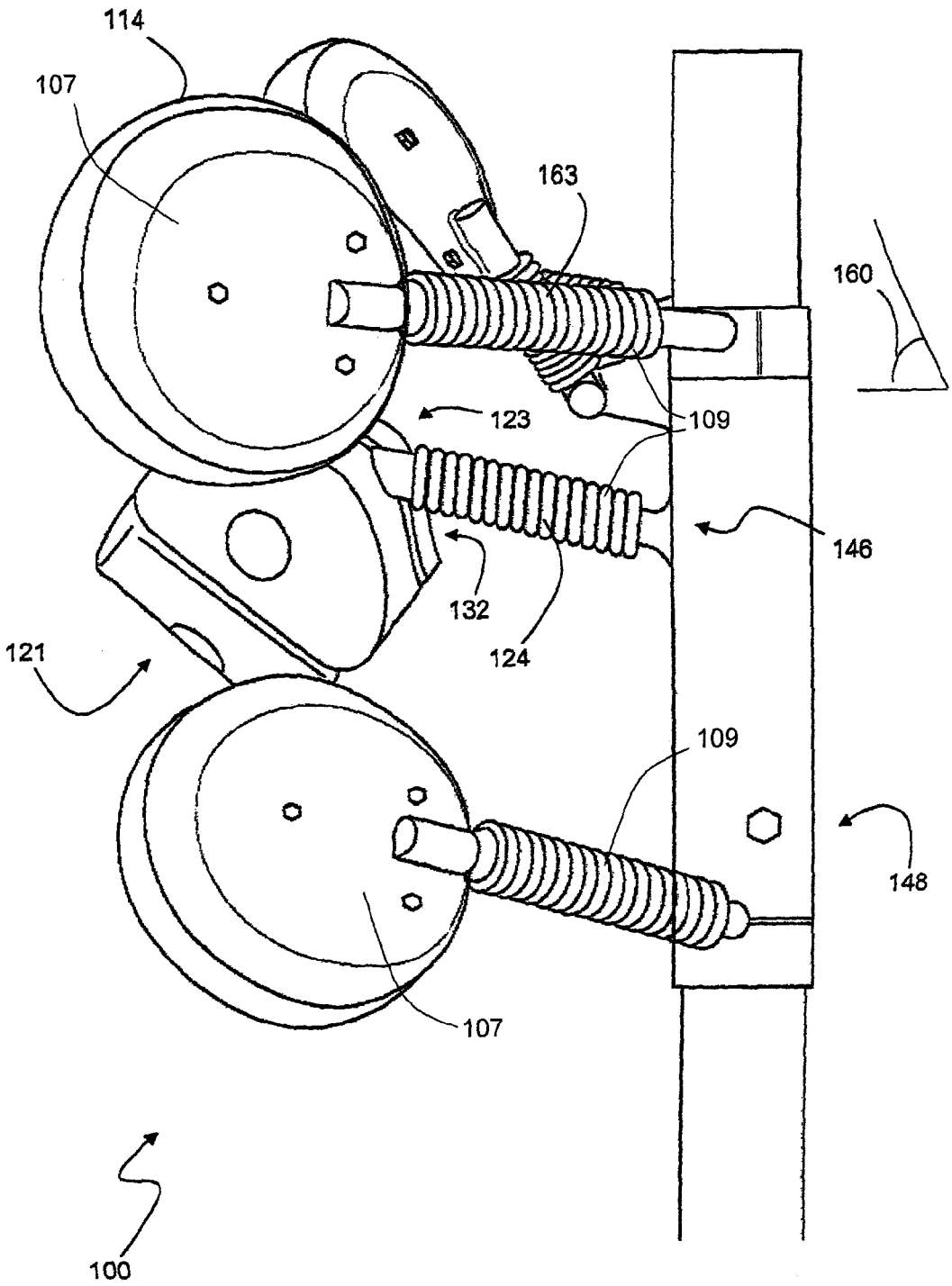
FIG. 3 is a side view of the training device shown in FIG. 1.

The arm members 103 of the training device 10 each include a pad 105 secured adjacent the outer end of the arm member 103. Plate members 107 (as can be seen in FIG. 3) are provided at the end of each of the arm members 103 onto which are secured the pads 105.

Each of the arm members 103 are mounted relative to the support frame 101 in positions such that striking the pads 105 allows the user to practice a particular punch. Further, each of pads 105 is resiliently mounted relative to the support frame 101 such that the pad 105 can flex relative to the support frame 101. In the embodiment shown, the resilient connection is provided by a spring member 109 joining the plate member 107 to the arm member 103. The spring members 109 are selected to have a stiffness such that the resistance when punching a pad 105 is similar to that which would be applied by a trainer holding the pad. While in the embodiment shown the spring member is provided between the plate member 107 and the arm member 103, it will be appreciated that the spring member may be placed at other locations in the length of the arm member 103, or between the arm member 103 and the support frame 101 to provide the resilient connection between the pad 105 and the support frame 101.

As can be seen in the Figures, the training device 100 comprises a first set of pads 111 for receiving right handed blows. The first set of pads comprises a plurality of pads 105 mounted relative to the support frame 101 at multiple heights. Each of the pads 105 of the first set 111 includes a face for receiving blows. The faces of the pads 105 of the first set 111 are each angled towards the right hand side of a user standing in front of the boxing training device 100. Each of the pads 105 of the first set 111 is therefore oriented for receiving right handed blows.

The training device 100 also comprises a second set of pads 113 for receiving left handed blows. The second set of pads 113 comprises a plurality of pads 105 mounted relative to the support frame 101 at multiple heights. Each of the pads 105 of the second set 113 includes a face for receiving blows. The faces of the pads 105 of the second set 113 are each angled towards the left hand side of a user standing in front of the boxing training device 100. Each of the pads 105 of the second set 113 is therefore oriented for receiving left handed blows.

In the embodiment shown, the training device 100 comprises a first arrangement 102 of pads, a second arrangement 104 of pads, and a third arrangement 106 of pads each of the arrangements located at different height levels. Each of the first, second and third arrangements include pads from both the first and second set of pads 111 and 113. The second arrangement 104 is disposed between the first arrangement 102 and the third arrangement 106.

The first arrangement 102 comprises a first pad 108, a second pad 110, a third pad 112 and a fourth pad 114. Each of the pads 108 to 114 are about 20 cm in diameter. The first and second pads 108 and 110 are angled towards the right side of a boxer standing in front of the device 100 and therefore form part of the first set of pads 111. The third and fourth pads 112 and 114 are angled towards the left side of a boxer standing in front of the device 100 and therefore form part of the second set of pads 113.

Together the pads 108 to 114 are configured to provide a concave inwardly hitting region 116 consisting of each of the surfaces of the pads. As would be apparent, the pads 108 to 114 are arranged for receiving a first set of strikes comprising head height punches. The first set of strikes comprises left and right straight hits as well as left and right overhands and hooks.

The first and fourth pads 108 and 114 are arranged outside and lower than the second and third pads 110 and 112. The first pad 108 is arranged for receiving right overhand and right hook punches. The second pad 110 is arranged for receiving right straight punches. The third pad 112 is arranged for receiving left straight punches. The fourth pad 114 is arranged for receiving left overhand and left hook punches.

Advantageously the second arrangement 104 is disposed below the first arrangement 102 and is adapted for receiving a second set of strikes comprising body height punches including rips and hooks.

The rips and hooks can be delivered to the sides 118 of the second arrangement 104 below an upper surface 120. The upper surface 120 is advantageously inclined toward the first arrangement 102 to allow left and right straight hits as well as left and right overhands to pass above the second arrangement and strike the first arrangement 102. Of benefit is the fact that the second arrangement 104 is positioned to provide a barrier to strikes directed towards the first arrangement 102 originating from below a desirable height. This is advantageous because student boxers are often drop their hands, providing an excellent opportunity for their opponent to strike their head with a punch.

In the case where a student boxer's hands are raised after striking the hitting region 116, dropping their hands will bring their hands into contact with the upper surface 120. If however the student, moves away from the device 100 and then drops their hands, their hands will not contact the upper surface 120. Nonetheless, if the student then moves back towards the device 100, and attempts to throw a punch towards the hitting region 116 without raising their hands, the student boxer will be presented with the second arrangement 104 providing a barrier. The student will accordingly be forced to raise their hands before striking the hitting region 116.

Figure 2:
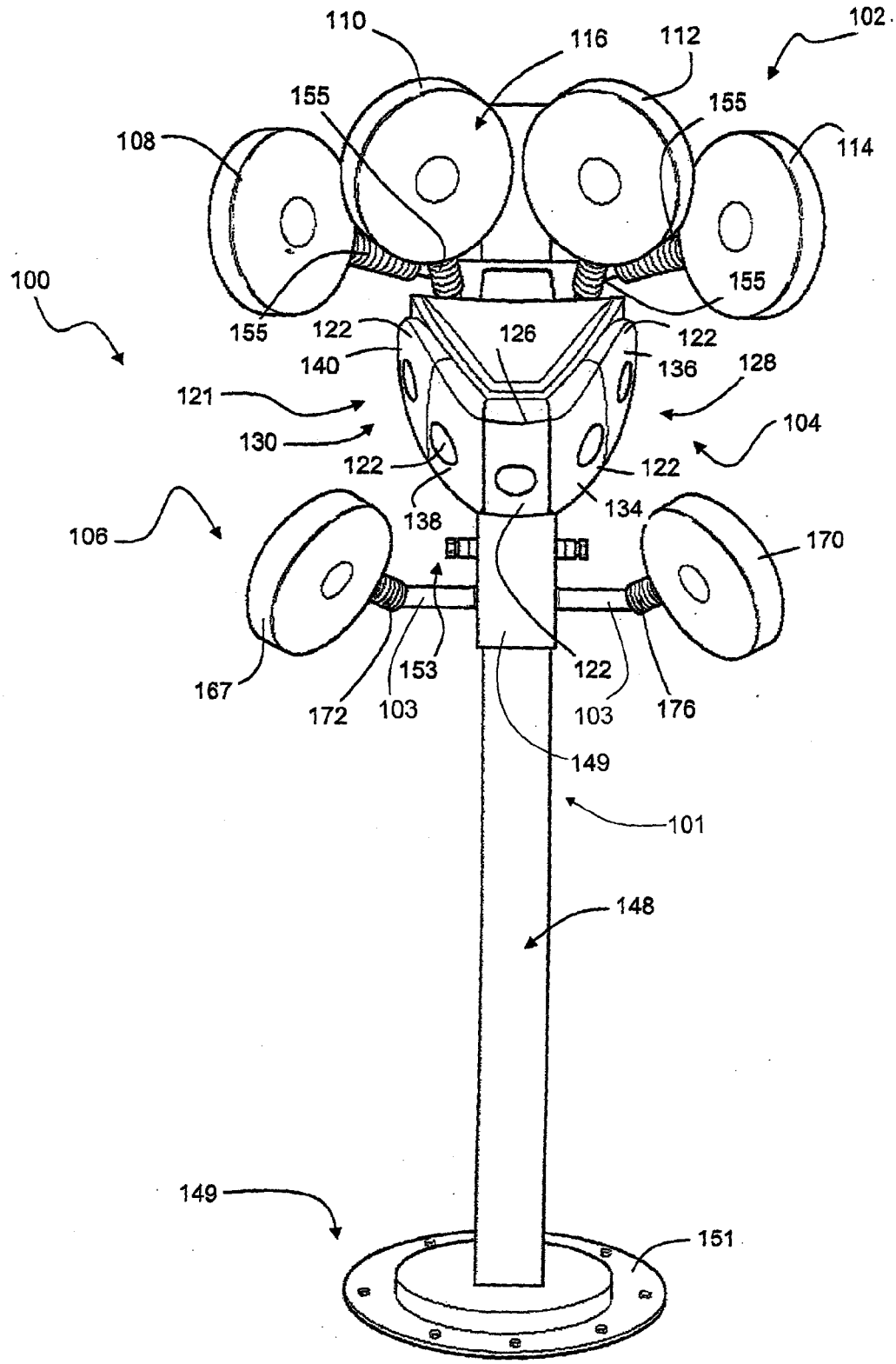
FIG. 2 is a front view of the training device shown in FIG. 1.

The second arrangement 104 is advantageous in its own right. As clearly shown in FIG. 2 the second arrangement 104 comprises a padded arrangement 121 in the form of a series of pads 122. The padded arrangement is secured to the support frame 101 by a single arm member 124. As shown in FIG. 3, the arm member 124 and associated spring member extends from a rear end 123 of the padded arrangement 121.

The series of pads 122 provide a first side surface 128, a second side surface 130 and a front surface 126. The first side surface 128 is configured for receiving a first set of hits 15 comprising right rips and hooks, and the second side surface 130 is configured for receiving a second set of hits comprising left rips and hooks. That is, the first side surface 128 forms part of the first set of pads 111 and the second side surface 130 forms part of the second set of pads 113. The front surface 126 is positioned directly in front of the user such that the front surface can be used for receiving a third set of hits comprising left and right uppercuts.

The arm member 124 extends from a rear surface 132 of the padded arrangement 121. The arm member 124 extends from the body of the padded arrangement 121 in a direction away from the front surface 126 as well as the two side surfaces 128 and 130.

The arm member 124 and associated spring member are advantageously configured for providing a resilient spring action that biases pads 122 towards a normal condition shown in the Figures. This allows to pads 122 to be hit with a flurry of hits in combination where the hits are derived from the first, second and third sets of hits as applied to their respective front and side surfaces.

The spring member provided in the arm member 124 is in the form of a resilient coil spring about 285 mm in length. The resilient coil spring has a pitch of 12 mm, an external diameter of 49 mm, a shear modulus of 79290 and a modulus of elasticity of 206843. Whilst a spring of this form has been seen to provide a useful biasing action, other arrangements would be clearly apparent and readily derived from ordinary trial. For example, the spring member may be provided in a form other than a coil spring.

The first side surface 128 comprises a first right area 134 and a second right area 136. The first right area 134 is arranged for receiving right rips and the second right area 136 is arranged for receiving right hooks. Similarly the second side surface 130 comprises a first left area 138 and a second left area 140 for respectively receiving left rips and hooks. Given that the second right and left areas 136 and 140 are located behind the first right and left areas 134 and 138 the boxer does not have to move away from the device 100 during an ordinary flurry of regular hitting.

As discussed, the front surface 126 of the second arrangement 104 is advantageously provided for receiving left and right uppercuts. The front surface 126 is disposed between the first side surface 128 and the second side surface 130. In comparison to the first arrangement 102, the second arrangement 104 provides a convex hitting surface. So as to assist with providing a barrier and preventing students from dropping their hands during training, the second arrangement 104 extends beyond the first arrangement 102 by an amount 142. In other embodiments, the second arrangement 104 extends to a similar point to the first arrangement 102.

The second right area 136 is arranged at an angle of 23 degrees to the first right area 134. The second right area 136 adjoins the front surface 126 and is arranged at an angle of 52 degrees relative to the front surface 126. In providing a mirror image, the front surface 126 is arranged 52 degrees relative to the first left area 138 which is arranged at 23 degrees to the second left area 140.

As would be apparent, the device 100 is suitable for both left and right handed boxers. This assists with training as the device can be readily used with both orthodox, and south paw boxers.

In the second arrangement 104, the front surface 126 is advantageously inclined at an angle 150 of 39.5 degrees relative to vertical, with an upper end thereof closer to the boxer, when the second arrangement 104 is the normal condition. At an angle of this nature, hitting the front surface 126 with an uppercut involves the front surface of the punch being brought into substantial alignment with the front surface 126. This serves to reduce the shock and stress experience by the wrist of the student. The angles of the areas 134 to 140 also advantageously reduce the stresses when correctly shaped rips and hooks are thrown with a desirable elbow position.

With this particular arrangement the front surface 126 comprises a relatively flat panel surface of about 190 mm in length and 8 cm in width. As shown in the Figures, the areas 134 and 138 are of a similar size. The rearward areas 136 and 138 are slightly larger in width.

The upper surface 120 is advantageously positioned, padded and sized for receiving downwardly directed elbow blows. This is considered advantageous as it allows for training of ultimate fighters who commonly practice such strikes. This ability to practice downwardly directed elbow blows is considered advantageous as it complements the uppercut, rip and hook strikes that can be made to the front surface 126 and the two side surfaces 128 and 130, respectively.

The upper surface 120 also functions as a headrest whereby a student is able 30 to rest his or head on the upper surface 120, as if resting on the shoulder of another boxer. This is considered advantageous because it creates a realistic position for the boxer to adopt during a training session as if sparring or boxing against another person.

As shown, in the Figures the upper surface 120 is substantially perpendicular to the front surface 126 and when in the normal position is disposed at about 40 degrees relative to horizontal in a direction downwardly towards the front surface 126.

During use the resilient connection between the second arrangement 104 and the support frame 101 absorbs the shock and throws the student's body back in a recovery direction. The resilient connection accordingly serves to reduce impact stresses while providing an exciting and relatively realistic experience. During a relatively vigorous flurry of punches to the second arrangement 104 it is estimated that padded arrangement 121 moves no more that 10 cm.

Moreover, the movement provided reduces stress associated with left and right uppercuts, rips and hooks to the surfaces 126, 128 and 130. The arm member 124 extends downwardly at an angle of about 12 degrees and flexes like a cantilever in the relevant directions.

In the arrangement the spring member in the arm member 124 is provided in the form of a helical coil spring which during a downwardly directed elbow blow flexes in a north-south direction and during hitting rips and hooks flexes in an east-west flexing direction. This advantageously provides for a relatively realistic boxing experience.

In addition the student is able to bend over to a hunched position in which the second arrangement 104 is able to simulate the head of an opponent bending over in a similar manner. Often boxers will bend as described in order to protect their head and body with their arms and gloves. The second arrangement 104 is particularly useful for practising strikes in this position.

The second arrangement 104 is about 26 cm in breadth in the direction between the second right area 136 and the first left area 140 at the end of the arrangement. The depth of the second arrangement 104 between the front surface 126 and the rear surface 132 is about 23 cm. The length of the front surface 126 is of a similar size.

In the case of the pads 108 to 114, they are each individually, mounted on a separate arm member 103. The pads 108 to 114 are adjoining and prevent a glove or fist from being caught therebetween. Each pad 108 to 114 is directed downwardly toward a focal region above the second arrangement 104. This advantageously serves to reduce the stress on the boxer's or students wrists and other joints.

The ends of the pads 108 and pads 114 at either side of the device 100 are separated by about 76 cm. In terms of the depth of the concave shape, the end of the pads 108 and 114 and are separated from the front of the pads 110 and 112 by about 16 cm.

Figure 4:
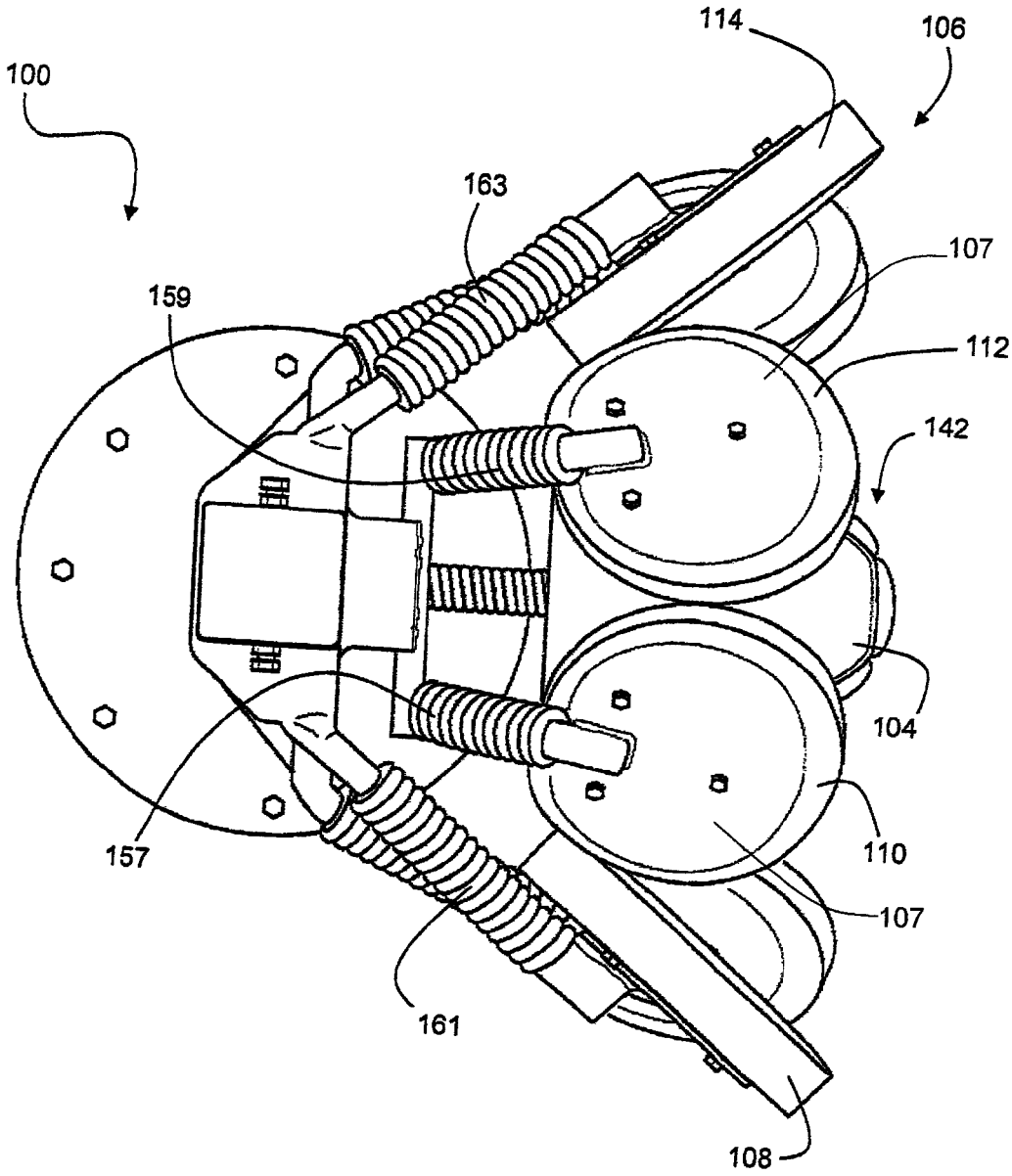
FIG. 4 is a top view of the training device shown in FIG. 1.

Referring to FIG. 4, the pads 110 and 112 are respectively mounted on arm member 157 and arm member 159. On a side view these arm members 157 and 159 are inclined forwardly at an angle of about 60 degrees to horizontal. This is shown as angle 160 in FIG. 3.

The outer pads 108 and 114 are respectively mounted on arm member 161 and arm member 163 at an angle of about eight degrees to horizontal on a side view. The internal angles provided by the arm member 157 and 159 in their plane comprises about 24 degrees and the internal angles provided by the arm member 161 and 163 comprise about 72 degrees.

Referring to FIG. 1 the third arrangement 106 comprises a first pad 167 and a second pad 170. From the outer end of the pads 167 and 170 they span about 76 cm and are separated by about 34 cm. The first pad 167 is connected to arm member 172 and the second pad 170 is connected to arm member 176.

Each of the pads 167 and 170 is turned inwardly at an angle of about 15 degrees relative to the vertical extending plane in which they lie. The arm members 172 and 176 form an internal angle of about 50 degrees and from a side on view are inclined at about 12 degrees above horizontal. Relative dimensions can be taken off the drawings which comprise traced photographs of a working prototype. Some allowance must however be made for the perspective from which the photographs were taken.

The pads 167 and 170 are directed downwardly in the manner described to receive a first set of hits comprising left and right rips with the student or boxer in a central position. That is, the first pad 167 forms part of the first set of pads 111 and the second pad 170 forms part of the second set of pads 113.

It will be appreciated that by standing in different positions, it will also be possible to use pads of the first and second sets for other punches to provide further training variations. In a left offset position the student is able to hit the first pad 167 with right uppercuts and in a right offset position the student is able to hit the second pad 170 with left uppercuts. Of course by positioning the body the student is also able to hit the pads 167 and 170 with hooks.

Figure 5:
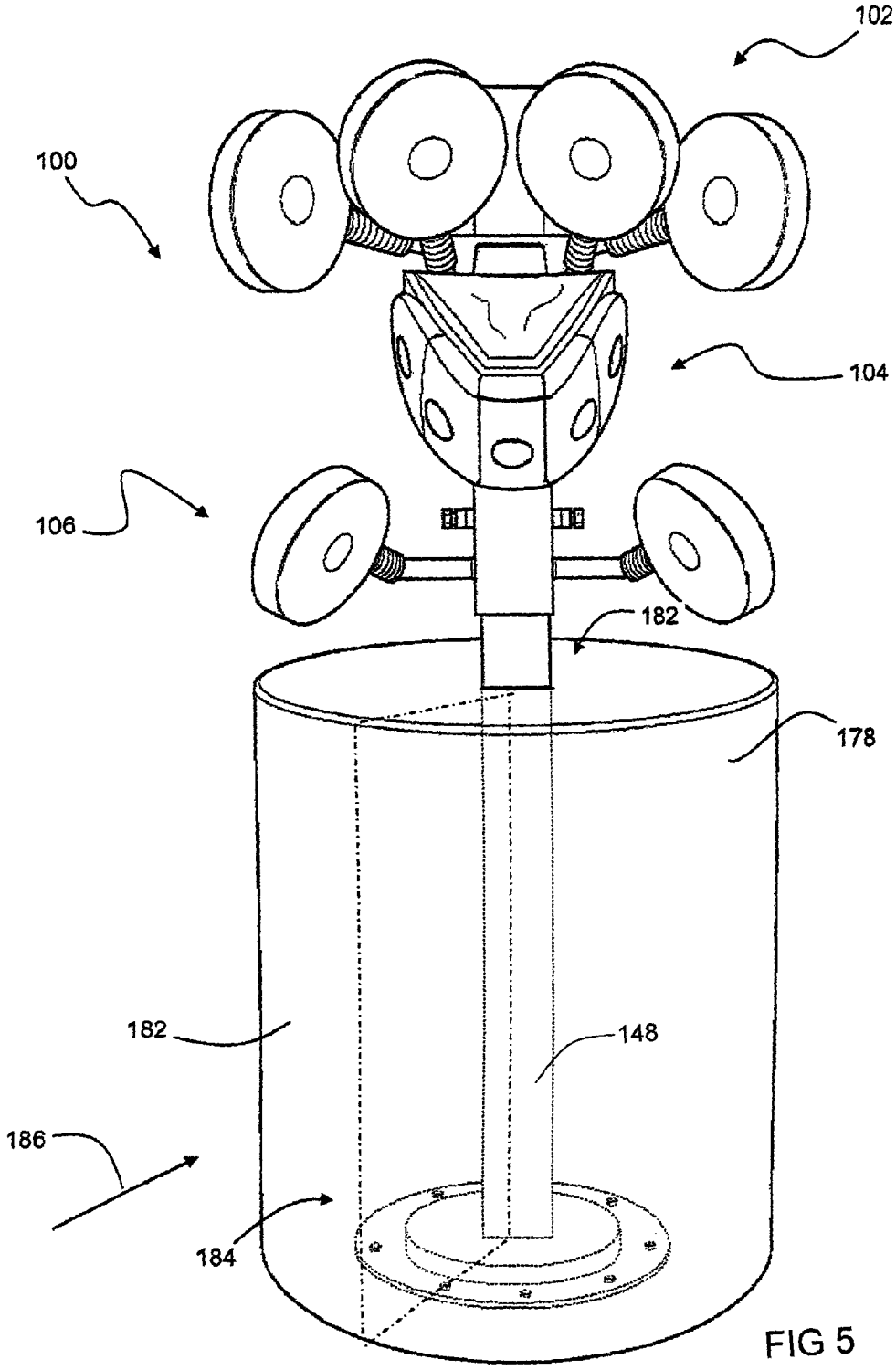
FIG. 5 is a front view of the training device shown in FIG. 1 showing the fitting of a kick pad.

Referring to FIG. 5 there is shown a kick pad 178 according to a further preferred embodiment of the present invention. The kick pad 178 comprises a body 180 that defines a passage 182 for receiving the post 148 and an opening 184 allowing the post 148 to be brought into the passage in a lateral direction 186. The opening 184 is formed from foam material that is resilient and which allows the post to pushed into the passage 182, through the opening 184. Once the post is in the passage 182, the opening 184 can be closed with the use of a fastener such Velcro™ material that extends along the length of the kick pad 178.

Figure 6:
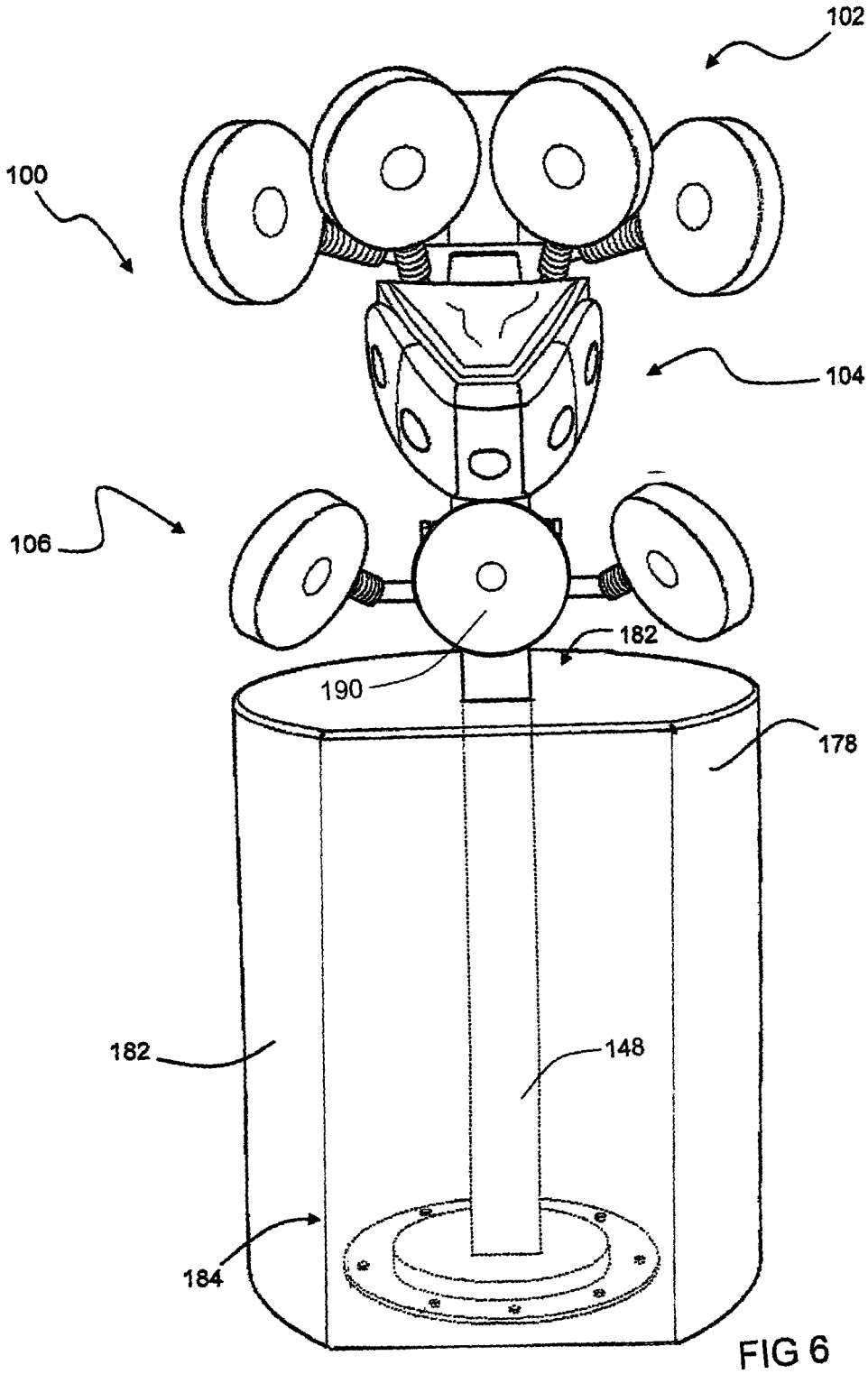
FIG. 6 is a front view a further embodiment of a training device according to the present invention.
Figure 7:
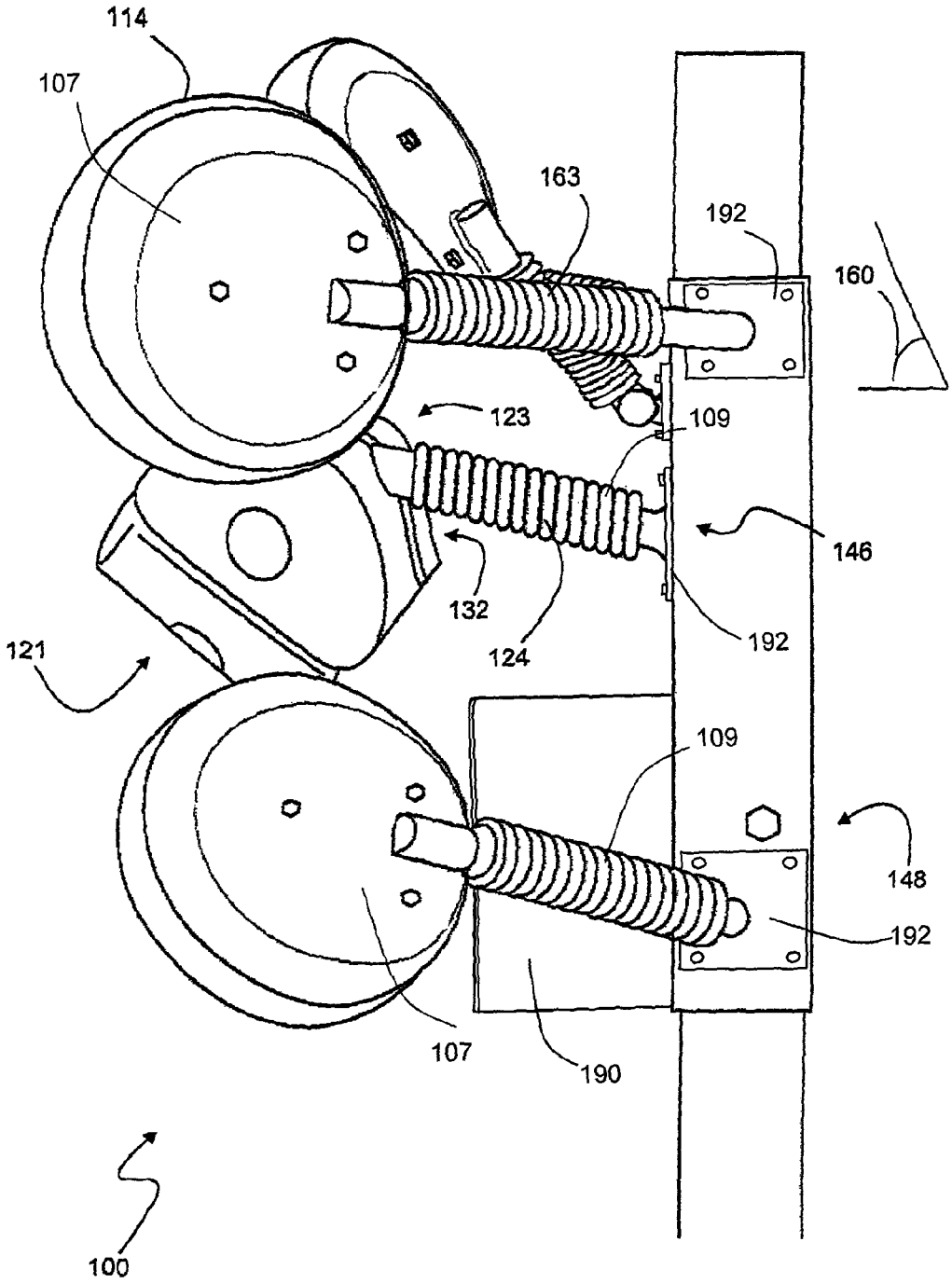
FIG. 7 is a side view of the training device of FIG. 6.

FIGS. 6 and 7 show a further embodiment of a training device 100 in accordance with the present invention. The training device 100 of FIGS. 6 and 7 is similar to that of FIGS. 1 to 5 with additional features. Firstly, the third arrangement 106 is provided with a third pad 190. The third pad is located centrally between the first and second pads 167 and 170 and is mounted to the sleeve 149. The third pad 190 may be used for practising straight right or lefts to the midriff. The third pad 190 may also be used by kick boxers to practice a push kick. In this embodiment, a front surface cylindrical kick pad 178 is cut away as shown in FIG. 6. This allows the kick boxer to kick to the third pad 190 without obstruction from the kick pad 178.

In the embodiment shown in FIGS. 6 and 7, the arm members 103 are provided as separate members attachable to and detachable from the support frame 101. Each arm member 103 may be provided with a connection plate 192 at the end remote from the pad, the connection plate 192 has holes therein to receive securing bolts fixable to the support frame 101. In this way, should any part of the arm member 103 become damaged due to repeated use; that arm member may be removed and replaced.

In a further embodiment (not shown), additional rear pads may be provided on the back of pads of the first and third arrangements 102 and 106. In particular, rear pads may be provided fitted to the first and fourth pads 108 and 114 of the first arrangement 102 and to the first and second pads 167 and 170 of the third arrangement 106. The rear pads may be provided as a pair of elongate pads, one of said pair being secured to the rear of the support frame 101 and extending outwardly along the arm members to the fourth pad of the first arrangement and the second pad of the third arrangement, the second of said pair being secured to the rear of the support frame 101 and extending outwardly along the arm members to the first pad of the first arrangement and the first pad of the third arrangement. The rear pads are provided to allow kick boxers to practice high and mid level kicks.

In use, it is expected that a boxer uses the training device 100 to direct a series of blows as directed by a trainer. The trainer is able to move around the boxer who is able to direct upper cuts, rips and hooks to a centrally located arrangement and overhands, straights and hook to an arrangement located thereabove. The second arrangement advantageously prevents a boxer from dropping their guard unless they move away from the apparatus. The apparatus may be fitted with sensors to calculate the power and frequency of punching combinations and lights to indicate a desired punching combination.

In addition it will be seen that there are a number of preferable features to the aspects described and other aspects that would be apparent. For example, preferably the front surface is inclined at an angle between 30 and 45 degrees relative to vertical when the device is in the normal condition. Preferably the padded second arrangement is convex outwardly with the second left area being arranged at about 20 degrees to the first left area which is arranged at about 50 degrees to the front surface which is then arranged at about 50 degrees to the first left area which is then arranged at about 20 degrees to the second left area. Preferably the upper surface is arranged substantially perpendicular to the front surface and when in the normal position is disposed at about 40 degrees relative to horizontal in a direction downwardly towards the front surface. Preferably the spring member is arranged for providing for a deviation of the padded arrangement of less than about 10 cm when hitting each of the front and two side surfaces in a relatively vigorous manner. Preferably the padded arrangement for being hit is between about 20 and 30 cm in breadth between the first and second surfaces and 15 and 30 cm in height along the front surface.

Preferably the second arrangement 104 for being hit is between about 20 and 30 cm in depth between the front surface and an opposite rear surface. Preferably the front surface comprises a relatively flat panel surface of between about 15 to 25 cm in length and between about 5 to 15cm in width. Preferably in the normal condition the arm member is arranged to extend about 15 degrees below horizontal in a direction away from the front surface. Preferably the ends of the arc of the padded arrangement are separated by at least 600 mm with the arc having a depth of at least 100 mm. Preferably the ends of the arc of the padded arrangement are separated by about 750 mm with the arc having a depth of about 150 mm.

It will be readily apparent to persons skilled in the relevant arts that various modifications and improvements may be made to the foregoing embodiments, in addition to those already described, without departing from the basic inventive concepts of the present invention Therefore, it will be appreciated that the scope of the invention is not limited to the specific embodiments described.

The invention claimed is:

1. A boxing training device comprising:

a support frame;

a first set of pads each resiliently connected relative to the support frame comprising a plurality of pads located at multiple heights having faces angled towards a right hand side of a boxer for receiving right handed blows;

a second set of pads each resiliently connected relative to the support frame comprising a plurality of pads located at multiple heights having faces angled towards a left hand side of the boxer for receiving left handed blows;

a first arrangement of pads including pads from each of the first and second sets, the first arrangement of pads defining a concave inwardly hitting region; and a second arrangement of pads including pads from each of the first and second sets defining an convex hitting surface;

wherein the second arrangement of pads comprises a single central padded arrangement forming the convex hitting surface, the second arrangement of pads includes a first side surface for receiving right hand strikes and a second side surface for receiving left hand strikes and a front surface located between the first and second side surfaces directed towards the boxer for receiving right and left hand strikes, wherein the front surface is independent of the first and second sets of pads.

2. A boxing training device in accordance with claim 1, wherein the front surface is angled to the vertical such that the upper end thereof is closer to the boxer such that the front surface is for receiving uppercuts.

3. A boxing training device in accordance with claim 1, wherein each pad of the first set of pads and the second set of pads is secured to the support frame by one of a plurality of arm members, each arm member including a spring member to provide the resilient connection and the second arrangement is secured to the support frame by a single arm member.

4. A boxing training device in accordance with claim 3, wherein the single arm member connecting the second arrangement is angled downwardly from the support frame.

5. A boxing training device in accordance with claim 3, wherein each pad is mounted on a plate member and the spring member is provided between the plate member and the respective arm member to which each pad is secured.

6. A boxing training device in accordance with claim 5, wherein each spring member comprises a coil spring.

7. A boxing training device in accordance with claim 3, wherein the arm members are removable from the support frame, the arm members being provided with connection plates at ends remote from the first set of pads and the second set of pads, the connection plates having holes therein to receive securing bolts fixable to the support frame.

8. A boxing training device in accordance with claim 1, wherein the second arrangement includes an upper surface extending between the first and second side surfaces angled downwardly towards the front surface such that the upper surface can be used as a head support or can receive downwardly directed elbow blows.

9. A boxing training device in accordance with claim 1, wherein the first side surface includes a first right area for receiving right rips and a second right area located behind the first right area for receiving right hooks and the second side surface includes a first left area for receiving left rips and a second left area located behind the first left area for receiving left hooks.

10. A boxing training device in accordance with claim 1, wherein the first arrangement of pads is located for receiving a set of strikes comprising head high punches.

11. A boxing training device in accordance with claim 10, wherein a third arrangement of pads is provided below the second arrangement of pads for receiving a set of strikes comprising left and right rips from a user standing in a central position in front of the device.

12. A boxing training device in accordance with claim 11, wherein the third arrangement comprises a first and second pads provided on respective arm members extending generally away from each other, the first pad arranged for receiving right rips and the second pad arranged for receiving left rips.

13. A boxing training device in accordance with claim 10, wherein the first arrangement comprises a first pad arranged for receiving right overhand and right hook punches, a second pad for receiving right straight punches, a third pad for receiving left straight punches and a fourth pad for receiving left overhand and left hook punches.

14. A boxing training device in accordance with claim 13, wherein the first and fourth pads are arranged outside and lower than the second and third pads.

15. A boxing training device in accordance with claim 13, wherein each of the first, second, third and fourth pads are connected to the support frame by a respective arm member.

16. A boxing training device in accordance with claim 12, wherein the third arrangement includes a third pad mounted between the first and second pads, the third pad for receiving strikes including left and right rips and push kicks.

17. A boxing training device in accordance with claim 1, wherein the support frame comprises a vertical post secured to the ground.

18. A boxing training device in accordance with claim 17, wherein a sleeve is provided for receiving the post, the arm members of the device being secured to the sleeve and the sleeve being slidable up and down the post to adjust the height of the pads.

19. A boxing training device in accordance with claim 18 wherein the sleeve includes fixing pins receivable in apertures in the post to secure the sleeve relative to the post.

* * * * *